US010605443B2

(12) United States Patent
Kim et al.

(10) Patent No.: US 10,605,443 B2
(45) Date of Patent: Mar. 31, 2020

(54) DEVICE FOR ATTACHING AND DETACHING HANDLE SURGICAL LIGHT

(71) Applicant: DENTIS CO., LTD., Daegu (KR)

(72) Inventors: Sung Guen Kim, Gyeongsangnam-do (KR); Yoon Sang Oh, Daegu (KR); Jung Il Kim, Daegu (KR); Jae Min Yun, Daegu (KR); Myung Gyu Sim, Daegu (KR); Jeong Su Kim, Daegu (KR); Hyun Ki Hong, Daegu (KR); Duk Ho Kong, Daegu (KR)

(73) Assignee: DENTIS CO., LTD., Daegu (KR)

( * ) Notice: Subject to any disclaimer, the term of this patent is extended or adjusted under 35 U.S.C. 154(b) by 129 days.

(21) Appl. No.: 15/751,588

(22) PCT Filed: Nov. 13, 2015

(86) PCT No.: PCT/KR2015/012225
§ 371 (c)(1),
(2) Date: Feb. 12, 2018

(87) PCT Pub. No.: WO2017/026585
PCT Pub. Date: Feb. 16, 2017

(65) Prior Publication Data

US 2018/0231225 A1 Aug. 16, 2018

(30) Foreign Application Priority Data

Aug. 11, 2015 (KR) ..... 10-2015-0113357

(51) Int. Cl.
*F21V 21/40* (2006.01)
*F21V 17/16* (2006.01)
(Continued)

(52) U.S. Cl.
CPC ..... *F21V 21/403* (2013.01); *F21V 17/10* (2013.01); *F21V 17/16* (2013.01); *F21W 2131/205* (2013.01); *F21Y 2105/18* (2016.08)

(58) Field of Classification Search
CPC ..... F21V 21/403; F21V 17/10; F21V 17/16
See application file for complete search history.

(56) References Cited

U.S. PATENT DOCUMENTS 4,280,167 A * 7/1981 Ellett ..... F21S 8/00 362/147
4,878,156 A * 10/1989 Hallings ..... F21V 21/403 362/109

(Continued)

FOREIGN PATENT DOCUMENTS

JP 2002-143055 A 5/2002
KR 10-1995-0026485 A 10/1995
KR 10-20130011216 A 7/2011

OTHER PUBLICATIONS

International Search Report dated Apr. 27, 2016, issued in International Application No. PCT/KR2015/012225.

*Primary Examiner* — Jong-Suk (James) Lee
*Assistant Examiner* — Christopher E Dunay
(74) *Attorney, Agent, or Firm* — Kilpatrick Townsend & Stockton LLP

(57) ABSTRACT

The present invention relates to a device for attaching and detaching a handle of a surgical light which is a medical lighting apparatus. The device, in the handle which is inserted into or separated from a surgical light shaft in a female-male coupling manner, comprises: a lock pin which protrudes in the axial direction of the surgical light shaft and is inserted into a lock hole formed on the handle so as to prevent the handle from being separated; a pin spring, supported on the surgical light shaft, for providing elastic force so that the lock pin protrudes to the outside of the (Continued)

surgical light shaft; a separation button which is provided on the outside of the handle and, when an external force for separating the handle from the surgical light shaft is applied, is pushed so as to enable the lock pin to be separated from the lock hole of the handle; and a button support body for supporting the separation button on the handle so that the separation button is movable to a certain degree. Therefore, the device prevents cross-infection which can occur while moving the surgical light during an operation, thereby enhancing safety and reliability of the surgical light.

6 Claims, 13 Drawing Sheets

(51) Int. Cl.

| | |
|---|---|
| ***F21V 17/10*** | (2006.01) |
| *F21Y 105/18* | (2016.01) |
| *F21W 131/205* | (2006.01) |

(56) References Cited

U.S. PATENT DOCUMENTS

| | | | | |
|---|---|---|---|---|
| 5,355,292 | A | 10/1994 | Hoftman et al. | |
| 5,562,344 | A * | 10/1996 | Hallings | F21V 21/403 362/399 |
| 9,480,391 | B2 * | 11/2016 | Gharibian | A61B 1/00142 |
| 10,321,970 | B1 * | 6/2019 | Hollopeter | A61B 90/36 |
| 2002/0089857 | A1 | 7/2002 | Borders et al. | |
| 2003/0210559 | A1 | 11/2003 | Jesurun et al. | |
| 2016/0302879 | A1 * | 10/2016 | Hampe | A61B 90/35 |

* cited by examiner

DEVICE FOR ATTACHING AND DETACHING HANDLE SURGICAL LIGHT

TECHNICAL FIELD

The present invention relates to a surgical light which is a medical lighting apparatus, and more particularly, to a device for attaching and detaching a handle of a surgical light, which can be attached to and detached from the surgical light.

BACKGROUND ART

Typically, a surgical light is a medical light fixture which is usually installed above an operating table so that light is projected in each direction to prevent shadows from being formed in a place where surgery is being performed.

The surgical light is configured to be changeable in height and position according to various conditions such as the progress of surgery. For this purpose, the surgical light is provided with a handle, and surgery is performed by moving the surgical light to a desired position using the handle.

Usually, to move the surgical light, surgical gloves are put on, and then the handle is moved to move the surgical light to a desired position. At this time, if the handle is contaminated, cross infection may occur in repeated practices of surgery.

To address this issue, a cover is placed on the handle, and the surgical light is moved by manipulating the handle in the cover. However, the cover is often displaced during movement of the surgical light, and the cover is disposable, which is not economical.

Although there is a handle detachably attachable to a surgical light, detachment thereof requires pressing of a button provided to the surgical light. As a result, cross infection may occur when the button is contaminated.

The statement in this section is technical information that the inventor of the present application has obtained to derive the present invention or that has been acquired in deriving the present invention, and cannot be necessarily taken as known technology disclosed to the general public before the application of the present invention.

DISCLOSURE

Technical Problem

Therefore, the present invention has been made in view of the above problems, and it is one object of the present invention to provide a device for attaching and detaching a handle of a surgical light that is provided with a detachable button on the handle to prevent cross infection which may occur in moving the surgical light during surgery and is capable of enhancing safety and reliability of the surgical light.

Technical Solution

In accordance with one aspect of the present invention, provided is a device for attaching and detaching a handle of a surgical light, the handle being fitted onto or detached from a surgical light shaft in a female-male coupling manner, the device comprising a lock pin protruding in a lateral direction of the surgical light shaft and inserted into a lock hole formed in the handle to prevent the handle from being displaced; a pin spring supported on the surgical light shaft to provide elastic force such that the lock pin protrudes outward from the surgical light shaft; a release button provided to an outer side of the handle so as to be pressed to displace the lock pin from the lock hole of the handle when external force is applied to detach the handle from the surgical light shaft; and a button supporting body for supporting the release button on the handle so as to be movable to a certain extent.

Preferably, a pin insertion portion is formed on one lateral surface of the surgical light shaft to guide rectilinear movement of the lock pin inserted thereinto, wherein an end portion of the lock pin is positioned to penetrate the pin insertion portion, and a displacement preventing portion is installed to prevent the lock pin from being displaced from the pin insertion portion, wherein the pin spring is configured to provide elastic force to the lock pin while being supported in the pin insertion portion.

Preferably, the release button comprises a support portion positioned at one side of the button such that the button supporting body may be assembled; and a pressing portion positioned at an opposite side of the button to contact the lock pin, the pressing portion protruding toward the lock pin to press the lock pin.

Preferably, the button supporting body comprises a button pin for perpendicularly penetrating the handle and the release button in a radial direction of the handle; and a displacement preventing portion provided at an end of the button pin to prevent the button pin from being displaced.

Preferably, the device further comprises a return spring arranged between the displacement preventing portion and an inner side surface of the handle to provide elastic force to cause the release button to return to an original position after the release button is pressed.

Preferably, the button supporting body comprises a button shaft for laterally penetrating the release button and the handle to rotatably support the release button on the handle.

Preferably, the handle is provided with a button support portion protruding to allow the release button to be coupled to the handle through the button shaft, wherein opposite side surfaces of the release button extend in a bent manner so as to be positioned on opposite sides of the button support portion, wherein the button shaft is installed so as to penetrate the opposite side surfaces of the release button and the button support portion of the handle.

The above and other objects and advantages of the present invention will become more apparent from exemplary embodiments thereof disclosed in the Best Mode and the accompanying drawings, in which the principal solutions described above and various other solutions according to the present invention will be further illustrated and described.

Advantageous Effects

A device for attaching and detaching a handle of a surgical light according to the present invention is configured such that the handle can be installed simply by fitting the handle onto a shaft and be easily detached by pressing a button. Therefore, convenience of attachment and detachment of the handle may be enhanced.

In addition, since the handle used in a specific surgical procedure can be easily removed by pressing the button provided on the handle, sterilized using a sterilizing device such as an autoclave, and then placed back in position, contamination of the surgical light other than the handle may be minimized, and thus the risk of cross infection may be avoided. Accordingly, safety and reliability of the surgical light may be enhanced.

Further, since the handle of the present invention can be repeatedly used after being sterilized, there is no need for a cover or the like. Thus, economical efficiency may be improved according to decrease in cost.

BEST MODE

Hereinafter, preferred embodiments of the present invention will be described with reference to the accompanying drawings.

Figure 1:
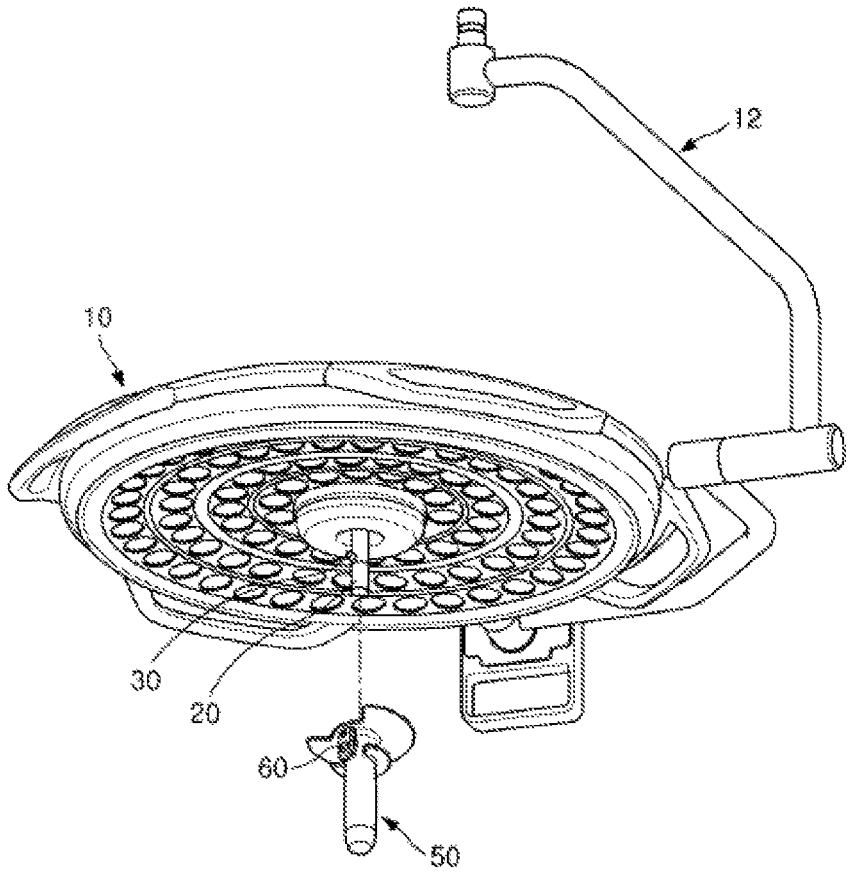
FIG. 1 is an overall perspective view showing a surgical light with a device for attaching and detaching a handle of the surgical light according to one embodiment of the present invention.
Figure 2:
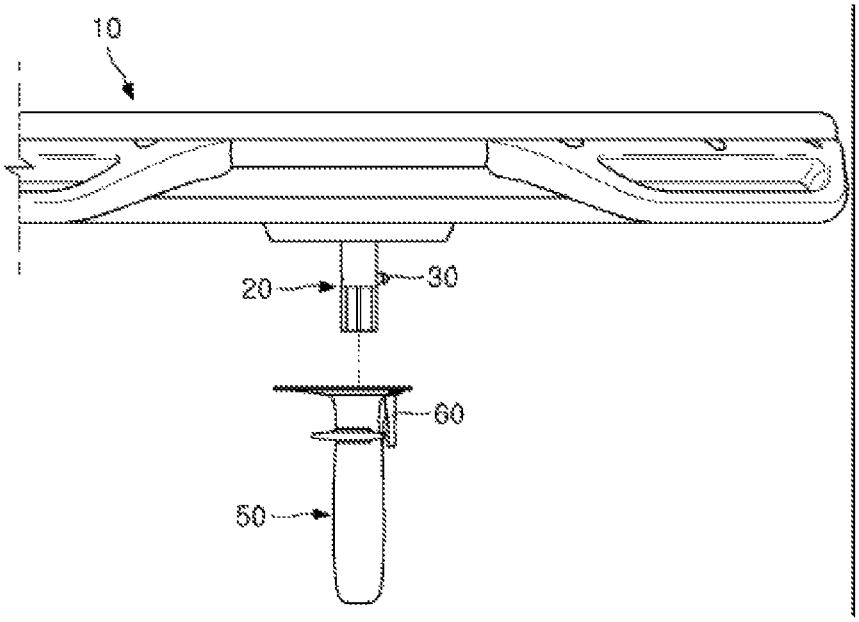
FIG. 2 is a side view showing the handle of FIG. 1, which is not installed.
Figure 3:
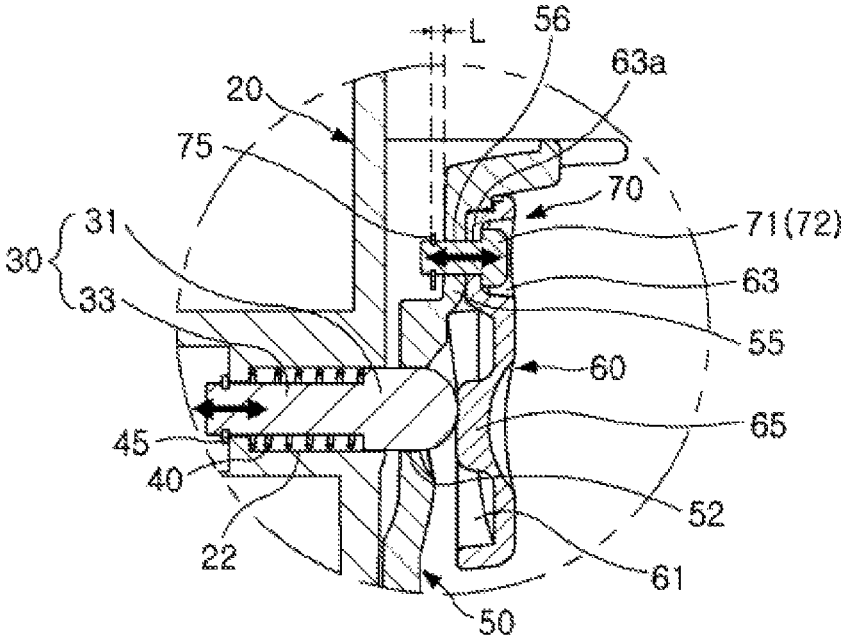
FIG. 3 is a cross-sectional view showing a main part of the device for attaching and detaching the handle of the surgical light according to one embodiment of the present invention.
Figure 4:
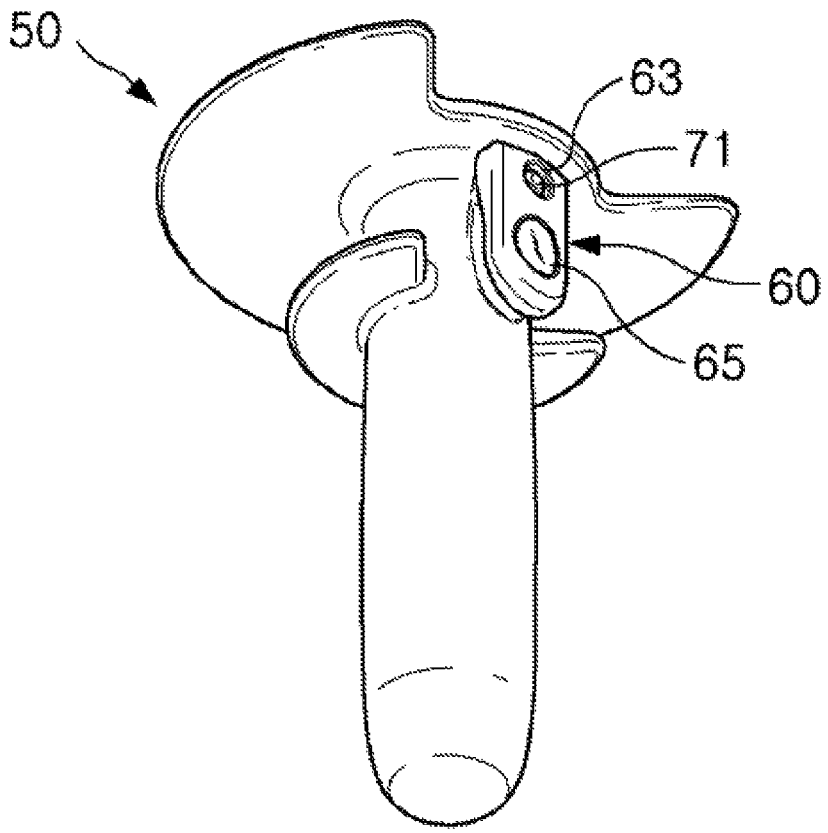
FIG. 4 is a perspective view showing the handle in the device for attaching and detaching the handle of the surgical light according to one embodiment of the present invention.
Figure 5:
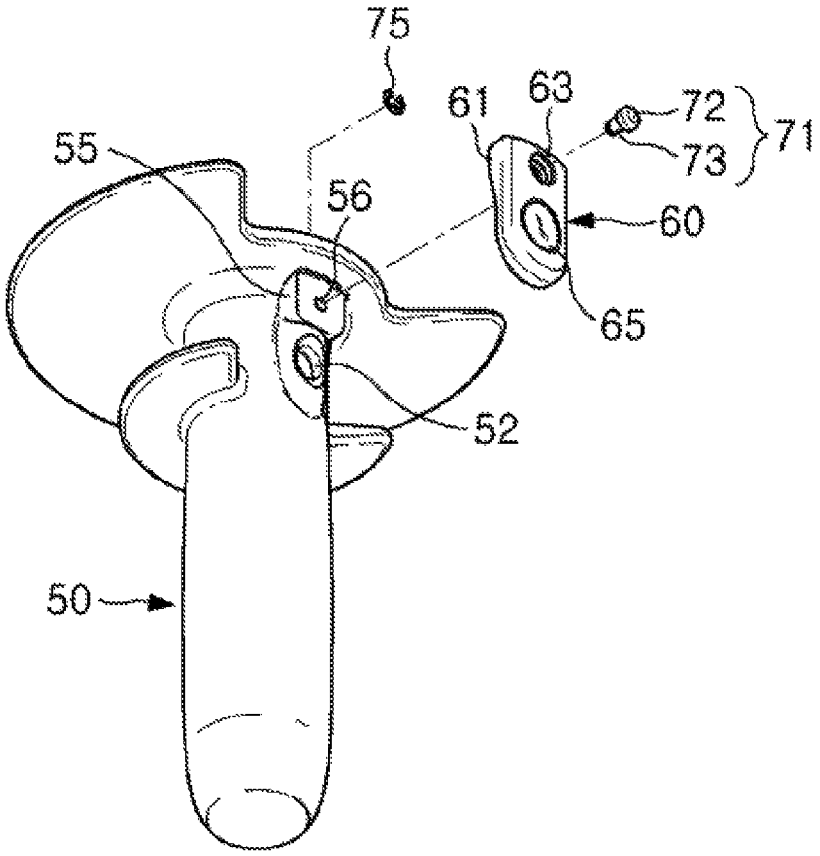
FIG. 5 is an exploded perspective view showing the handle in the device for attaching and detaching the handle of the surgical light according to one embodiment of the present invention.
Figure 6:
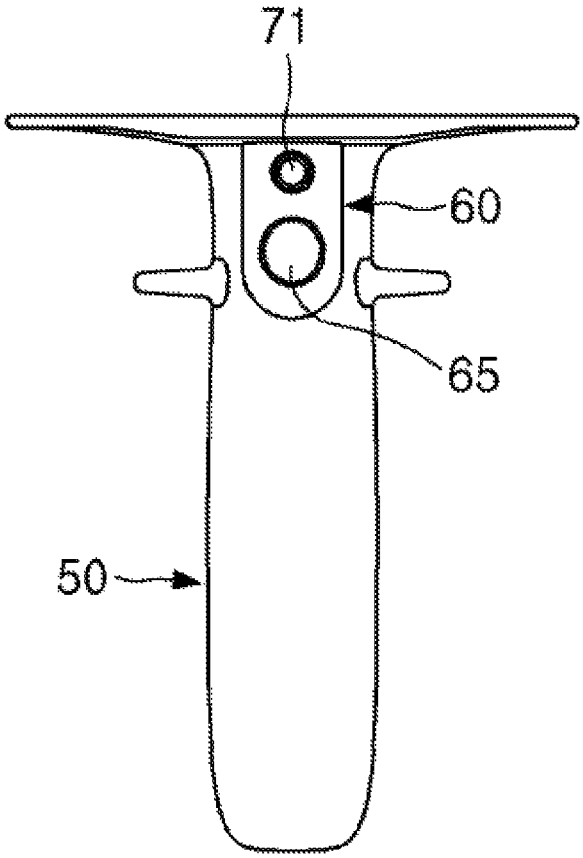
FIG. 6 is a front view showing the handle in the device for attaching and detaching the handle of the surgical light according to one embodiment of the present invention.
Figure 7:
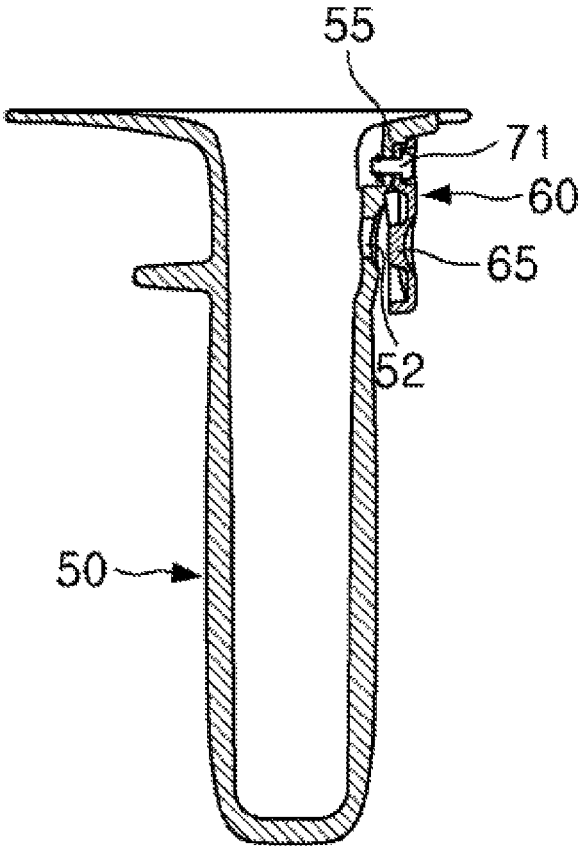
FIG. 7 is a cross-sectional view taken along line A-A in FIG. 6.
Figure 8:
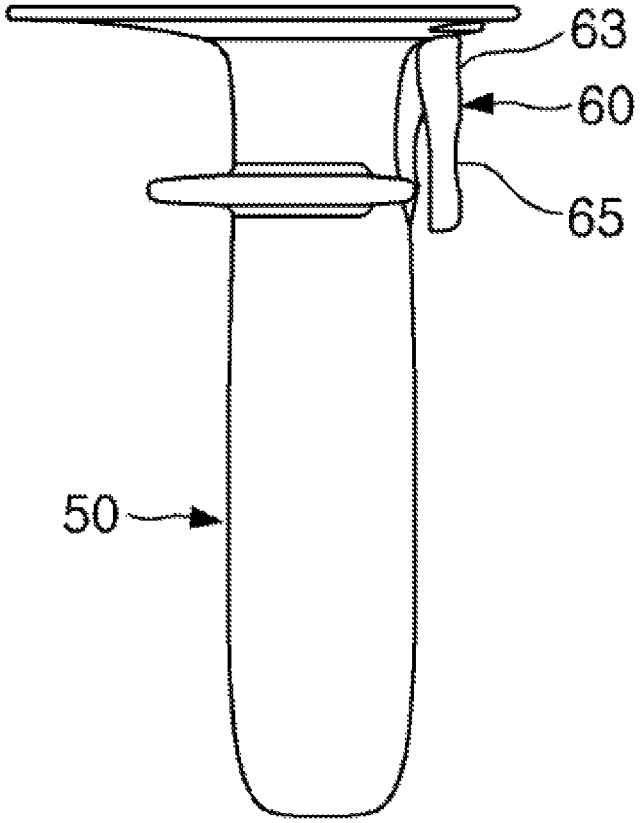
FIG. 8 is a side view showing the handle in the device for attaching and detaching the handle of the surgical light according to one embodiment of the present invention.
Figure 9:
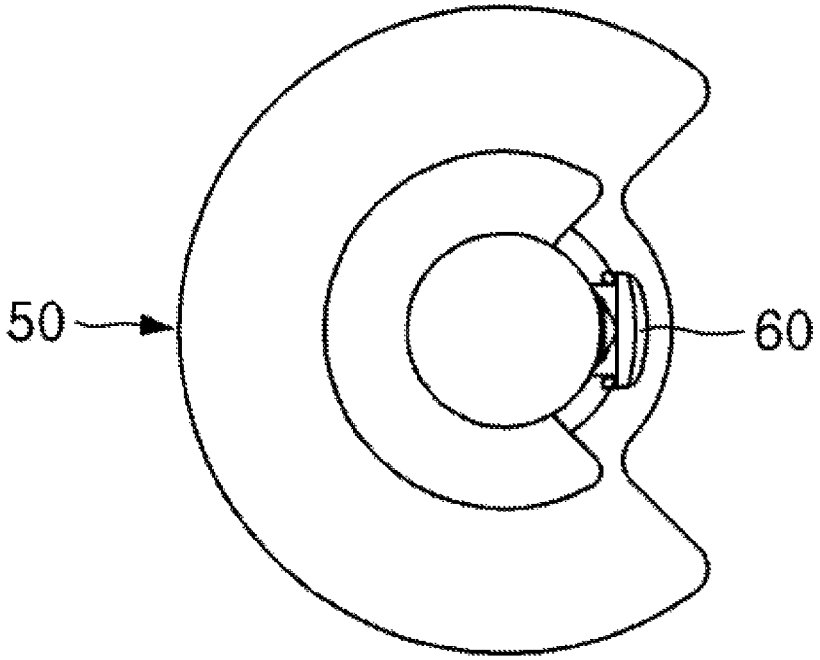
FIG. 9 is a plan view showing the handle in the device for attaching and detaching the handle of the surgical light according to one embodiment of the present invention.

FIGS. 1 to 9 are views showing a device for attaching and detaching a handle of a surgical light according to one embodiment of the present invention. FIG. 1 is an overall perspective view of the surgical light, FIG. 2 is a side view showing the handle, which is not installed yet, and FIG. 3 is a cross-sectional view of a main part of the attachment/detachment device. FIG. 4 is a perspective view of the handle, FIG. 5 is an exploded perspective view of the handle, and FIG. 6 is a front view of the handle. FIG. 7 is a cross-sectional view of the handle, FIG. 8 is a side view of the handle, and FIG. 9 is a plan view of the handle.

Referring to FIG. 1, reference numeral 10 denotes a surgical light having a lighting device disposed thereunder, and reference numeral 12 denotes a support for supporting the surgical light.

The surgical light 10 is provided at the lower center thereof with a surgical light shaft 20 protruding downward to a long distance, and a handle 50 may be mounted on the surgical light shaft 20.

The handle 50 is attached to and detached from the surgical light shaft 20 in a female-male coupling manner. The attachment/detachment device will be described in detail with reference to FIGS. 2 to 9.

Referring to FIG. 3, the device for attaching and detaching a handle of a surgical light according to an embodiment of the present invention includes a lock pin 30 protruding in a lateral direction of the surgical light shaft 20 and inserted into a lock hole 52 formed in the handle 50, a pin spring 40 supported on the surgical light shaft 20 to provide elastic force such that the lock pin 30 protrudes outward from the surgical light shaft 20, a release button 60 provided to an outer side of the handle 50 so as to be pressed to displace the lock pin 30 from the lock hole 52 of the handle 50 when external force is applied to detach the handle 50 from the surgical light shaft 20, and a button supporting body 70 for supporting the release button 60 on the handle 50 so as to be movable to a certain extent.

The main components of the device for attaching and detaching the surgical light handle of this embodiment configured as above and the assembly structures thereof will be described in detail.

First, the lock pin 30 and the assembly structure of the lock pin 30 are constituent parts that cause the handle 50 to be caught by the lock pin 30 so as not to be released after the handle 50 is fitted.

As exemplarily shown in FIG. 3, the lock pin 30 may include a head portion 31 and a stem portion 33. Preferably, the head portion 31 is formed in a hemispherical shape in order to facilitate detachment of the handle 50 when the handle 50 is removed. Preferably, the stem portion 33 is formed to a smaller outer diameter than the head portion 31 to allow the pin spring 40 to be mounted therearound.

A pin insertion portion 22 may be formed on one lateral surface of the surgical light shaft 20 to guide rectilinear movement of the lock pin 30 inserted thereinto. The pin insertion portion 22 is formed in a hole structure having a certain depth.

The lock pin 30 is inserted into and positioned in the pin insertion portion 22. Preferably, with the end portion of the stem portion 33 of the lock pin 30 positioned to penetrate the pin insertion portion 22, a displacement preventing ring 45, i.e., a snap ring or the like, is installed so as to be caught by the bottom surface of the pin insertion portion 22 and prevented from being displaced. Of course, the displacement preventing ring 45 can be replaced with any other components that prevent the lock pin 30 from being displaced, such as a nut or an engagement pin to be fastened or fixed to the end of the lock pin 30.

As described above, the pin spring 40 is configured to provide elastic force to the lock pin 30 while being arranged around the stem portion 33 of the lock pin 30 and supported in the pin insertion portion 22. The pin spring 40 is preferably formed by a coil spring as illustrated in the figure.

Next, the release button 60 has an approximately rectangular shape as illustrated in FIGS. 4 and 5, and the peripheral surface thereof is formed to have a skirt surface 61 extending from the top surface in a curved manner.

The release button 60 includes a support portion 63 positioned at an upper side of the button and connected with the button supporting body 70, and a pressing portion 65 positioned at a lower side of the button to contact the lock pin 30 and protruding toward the lock pin 30 to press the lock pin.

Here, the support portion 63 is preferably formed in a groove structure such that the head portion 72 of the button pin 71, which will be described below, is caught.

Preferably, the pressing portion 65 is formed to be smaller than the lock hole 52 formed in the handle 50 so as to press the lock pin 30 completely.

Preferably, the pressing portion 65 is formed in a structure having a top surface depressed in a round shape. This is intended to allow the user to correctly locate the pressing position to press the button.

Next, the button supporting body 70 preferably includes a button pin 71 for perpendicularly penetrating the release button 60 and the handle 50 in the radial direction of the handle 50, and a displacement preventing ring 75 provided to an end of the button pin 71 to prevent the button pin 71 from being displaced.

A button support portion 55 protrudes from the handle 50 to allow the release button 60 to be connected through the button supporting body 70. The button support portion 55 is provided with a hole 56, through which the button pin 71 is arranged.

The button pin 71 may include a head portion 72 and a pin portion 73. The head portion 72 is engaged with the support portion 63 of the release button 60 and the pin portion 73 is inserted into the hole 56 of the button support portion 55 in a penetrating manner.

The displacement preventing ring 75, which may be configured by an E-ring, a snap ring, or the like, is installed at the end of the button pin 71 on the back of the button support portion 55 to prevent the button pin 71 from being displaced.

Preferably, the length of the button pin 71 and the installation position of the displacement prevention ring 75 are set to provide a certain clearance distance L to allow the release button 60 to be moved when the release button 60 is pressed, as shown in FIG. 3.

Now, a process of attaching and detaching a handle using the attachment/detachment device according to this embodiment configured as described above will be described.

Referring to FIGS. 1 and 3, when the handle 50 is pushed onto the outer side of the surgical light shaft 20 in order to mount the handle 50 on the surgical light shaft 20, the lock pin 30 is retracted as the handle 50 is fitted. When the handle is fully fitted, the lock pin 30 may be inserted into the lock hole 52 of the handle 50. Thereby, the handle 50 can be mounted on the surgical light shaft 20.

In order to change the position of the surgical light 10 in this state, the surgical light can be moved using the handle 50.

When the release button 60 is pressed with the thumb or the like with the handle 50 held to remove or detach the handle 50, the release button 60 is rotated about the button supporting body 70 in the pressing direction. At the same time, the pressing portion 65 presses the lock pin 30 to release the lock pin 30 from the lock hole 52. At this time, if the handle 50 is pulled downward, the handle 50 may be removed from the surgical light shaft 20.

Thereafter, if necessary, the handle 50 removed as described above may be sterilized using a sterilizing device such as an autoclave, and then installed again.

Next, a brief description will be given of a device for attaching and detaching a handle of a surgical light according to another embodiment of the present invention. In describing other embodiments, the same or like parts as those of the above-described embodiment are assigned the same reference numerals, and a redundant description thereof will be omitted.

Figure 10:
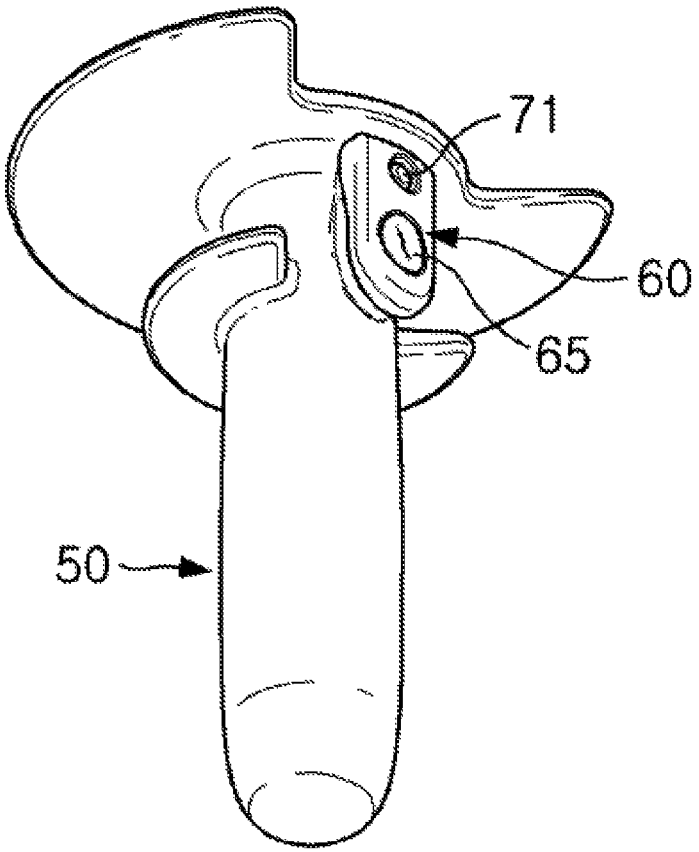
FIG. 10 is a perspective view showing a handle in a device for attaching and detaching the handle of a surgical light according to another embodiment of the present invention.
Figure 11:
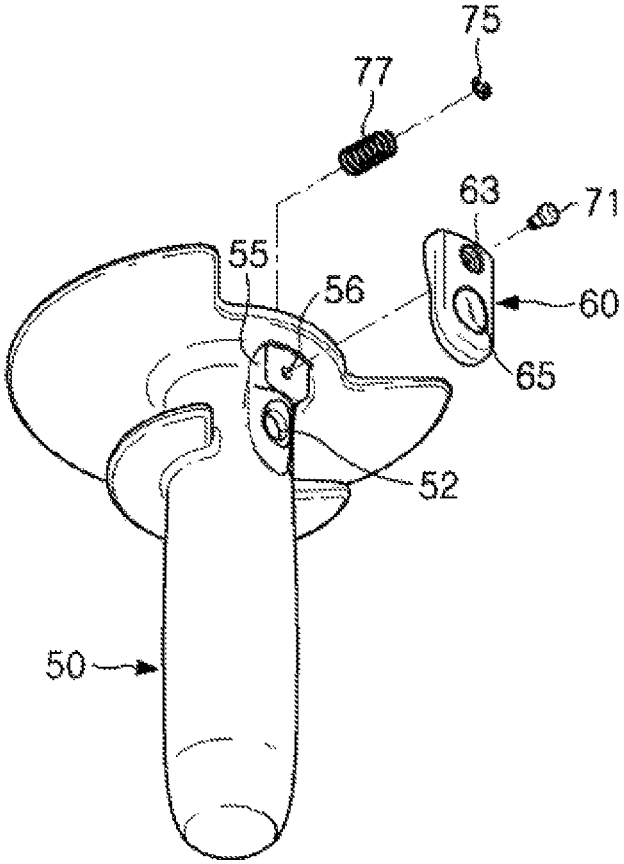
FIG. 11 is an exploded perspective view showing the handle in the device for attaching and detaching the handle of the surgical light according to another embodiment of the present invention.

FIGS. 10 and 11 are a perspective view and an exploded perspective view showing a handle in a device for attaching and detaching the handle of a surgical light according to another embodiment of the present invention.

All the configurations except the configuration of the button supporting body 70 are the same as those of the previous embodiment.

Referring to FIGS. 10 and 11, the button supporting body 70 in this embodiment includes a return spring 77 arranged between the displacement preventing ring 75 and the inner side surface of the handle 50 to provide elastic force to the button pin 71 to cause the release button 60 to returns to an original position thereof after the release button 60 is pressed. Preferably, the return spring 77 is installed at a clearance distance L in FIG. 3.

Therefore, when the release button 60 is pressed to separate the handle 50, the return spring 77 stores elastic force while being compressed. When the release button 60 is released, the release button 60 can be restored to the original position thereof by the elastic force of the return spring 77.

Figure 12:
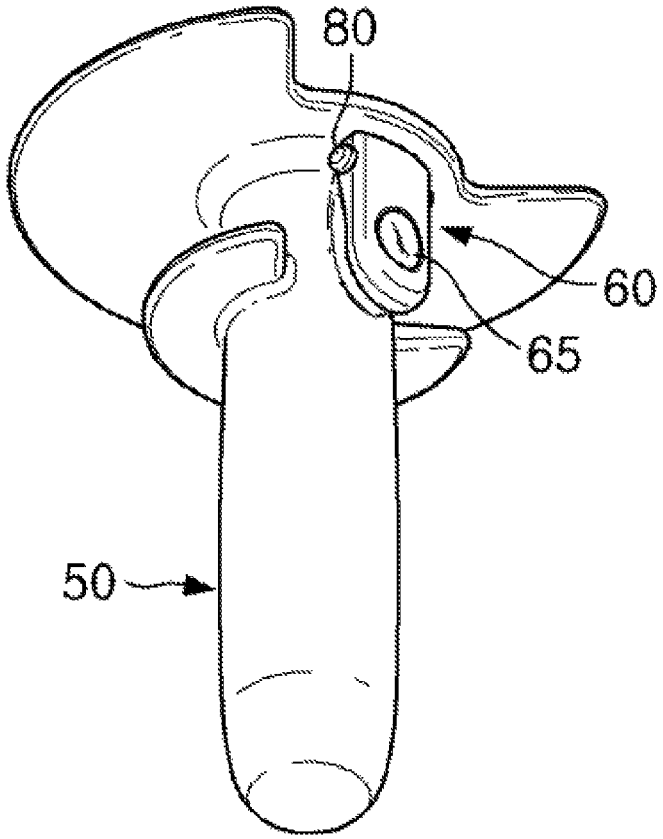
FIG. 12 is a perspective view showing a handle in a device for attaching and detaching the handle of a surgical light according to yet another embodiment of the present invention.
Figure 13:
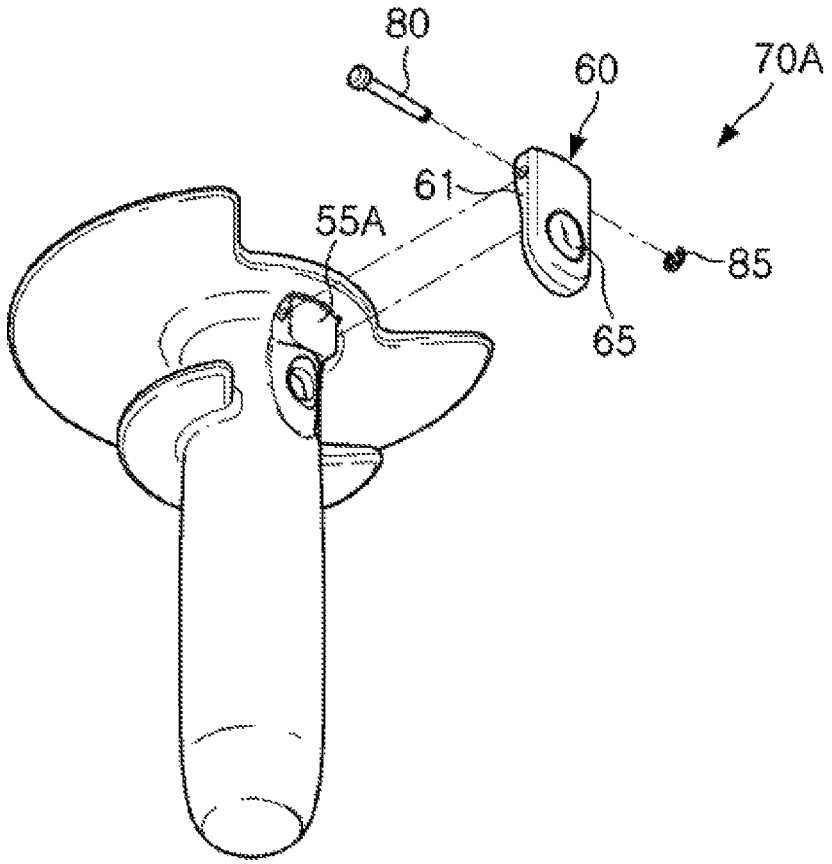
FIG. 13 is an exploded perspective view showing the handle in the device for attaching and detaching the handle of the surgical light according to yet another embodiment of the present invention.

FIGS. 12 and 13 are a perspective view and an exploded perspective view showing a handle in a device for attaching and detaching the handle of a surgical light according to yet another embodiment of the present invention.

In yet another embodiment, the direction of coupling of a button supporting body 70A is different from that in the previous two embodiments.

Referring to FIGS. 12 and 13, the button supporting body 70A includes a button shaft 80 for laterally penetrating the release button 60 and the handle 50 to rotatably support the release button 60 on the handle 50.

To this end, the handle 50 is provided with a button support portion 55A protruding to allow the release button 60 to be coupled to the handle through the button shaft 80.

The skirt surface 61 extends on opposite side surfaces of the release button 60 in a bent manner so as to be positioned on both sides of the button support portion 55A, and thus the button shaft 80 is arranged to penetrate the opposite side surfaces of the release button 60 and the button support portion 55A of the handle 50.

Of course, a displacement preventing ring 85 is preferably provided at the end of the button pin 71.

As described above, the technical ideas described in the embodiments of the present invention can be implemented independently, or can be implemented in combination with each other. While the present invention has been particularly shown and described with reference to exemplary embodiments thereof disposed in the Best Mode and the drawings, such descriptions are merely illustrative. Many variations and other equivalent embodiments will be apparent to those skilled in the art. Accordingly, the technical scope of the present invention should be defined by the appended claims.

<Reference Numerals>

| | |
|---|---|
| 10: Surgical light | 12: support |
| 20: Surgical light shaft | 22: Pin insertion portion |
| 30: Lock pin | 40: Pin spring |

-continued

| <Reference Numerals> | |
|---|---|
| 50: Handle | 55: Button support portion |
| 60: Release button | 63: Support portion |
| 65: Pressing portion | 70: Button supporting body |
| 71: Button pin | 75: Displacement preventing ring |

INDUSTRIAL APPLICABILITY

The present invention relates to a device for attaching and detaching a handle of a surgical light which is configured such that the handle can be installed simply by fitting the handle onto a shaft and be easily detached by pressing a button. Therefore, convenience of attachment and detachment of the handle may be enhanced.

Accordingly, the present invention is applicable to all typical lights. In particular, the present invention is expected to be applied to industrial fields such as surgery or medical lighting, because it can enhance user convenience and secure health safety through sterilization and disinfection in an operating procedure.

The invention claimed is:

1. A device for attaching and detaching a handle of a surgical light, the handle being fitted onto or detached from a surgical light shaft in a female-male coupling manner, the device comprising:

a lock pin protruding in a lateral direction of the surgical light shaft and inserted into a lock hole formed in the handle to prevent the handle from being displaced;

a pin spring supported on the surgical light shaft to provide elastic force such that the lock pin protrudes outward from the surgical light shaft;

a detachable button provided to an outer side of the handle so as to be pressed to displace the lock pin from the lock hole of the handle when external force is applied to detach the handle from the surgical light shaft; and a button supporting body for supporting the detachable button on the handle so as to be movable to a certain extent, wherein the button supporting body comprises:

a button pin for perpendicularly penetrating the handle and the detachable button in a radial direction of the handle; and a displacement preventing portion provided at an end of the button pin to prevent the button pin from being displaced.

2. The device according to claim 1, wherein a pin insertion portion is formed on one lateral surface of the surgical light shaft to guide rectilinear movement of the lock pin inserted thereinto, wherein an end portion of the lock pin is positioned to penetrate the pin insertion portion, and a displacement preventing portion is assembled to prevent the lock pin from being displaced from the pin insertion portion, wherein the pin spring is configured to provide elastic force to the lock pin while being supported in the pin insertion portion.

3. The device according to claim 1, wherein the detachable button comprises:

a support portion positioned at one side of the detachable button such that the button supporting body may be assembled; and a pressing portion positioned at an opposite side of the detachable button to contact the lock pin, the pressing portion protruding toward the lock pin to press the lock pin.

4. The device according to claim 1, further comprising:

a return spring arranged between the displacement preventing portion and an inner side surface of the handle to provide elastic force to cause the detachable button to return to an original position after the detachable button is pressed.

5. A device for attaching and detaching a handle of a surgical light, the handle being fitted onto or detached from a surgical light shaft in a female-male coupling manner, the device comprising:

a lock pin protruding in a lateral direction of the surgical light shaft and inserted into a lock hole formed in the handle to prevent the handle from being displaced;

a pin spring supported on the surgical light shaft to provide elastic force such that the lock pin protrudes outward from the surgical light shaft;

a detachable button provided to an outer side of the handle so as to be pressed to displace the lock pin from the lock hole of the handle when external force is applied to detach the handle from the surgical light shaft; and a button supporting body for supporting the detachable button on the handle so as to be movable to a certain extent, wherein the button supporting body comprises:

a button shaft for laterally penetrating the detachable button and the handle to rotatably support the detachable button on the handle.

6. The device according to claim 5, wherein the handle is provided with a button support protruding to allow the detachable to be coupled to the handle through the button shaft, wherein opposite side surfaces of the detachable extend in a bent manner so as to be positioned on opposite sides of the button support portion, wherein the button shaft is installed so to penetrate the opposite side surfaces of the detachable button and the button support portion of the handle.

* * * * *